United States Patent [19]

Effinger et al.

[11] Patent Number: 4,739,718

[45] Date of Patent: Apr. 26, 1988

[54] METHOD AND APPARATUS FOR SEWING A WAISTBAND AND APPLYING IT TO A GARMENT

[75] Inventors: Ludwig Effinger, Wörth/Main; Alfred Boeckmann; Erich Willenbacher, both of Kaiserslautern; Norbert Rahm, Heiligenmoschel, all of Fed. Rep. of Germany

[73] Assignee: Pfaff Industriemaschinen GmbH, Fed. Rep. of Germany

[21] Appl. No.: 84,415

[22] Filed: Aug. 10, 1987

[30] Foreign Application Priority Data

Aug. 26, 1986 [DE] Fed. Rep. of Germany ..... 3628934

[51] Int. Cl.[4] ..... D05B 23/00

[52] U.S. Cl. ..... 112/262.3; 112/121.27; 112/140; 112/104

[58] Field of Search ..... 112/121.27, 121.26, 112/140, 136, 262.1, 262.3, 104

[56] References Cited

U.S. PATENT DOCUMENTS

| | | | |
|---|---|---|---|
| 3,183,869 | 5/1965 | Astrupgaard et al. | 112/140 |
| 3,507,234 | 4/1970 | Bryan | 112/121.27 |
| 3,780,679 | 12/1973 | Hanes, Jr. et al. | 112/121.27 |
| 4,048,931 | 9/1977 | Hodgins | 112/104 |
| 4,114,544 | 9/1978 | Miyachi et al. | 112/104 |

*Primary Examiner*—H. Hampton Hunter
*Attorney, Agent, or Firm*—McGlew and Tuttle

[57] ABSTRACT

A method and an apparatus for sewing a waistband and applying it to a garment using a two-needle sewing machine and a blindstitch folding attachment for the waistband. A waistband is turned up to form the end of a waistband extension and is finished with a shaped seam in the region of the turnup edge. With the top sides lying one on the other, they are trimmed and then supplied by the blindstitch folding attachment to the needles spread out with the trimmed edge pointing in a feed direction. The lateral edges, turned up, are at first sewn onto the central part of the waistband while being transported backwardly. With the sewing machine stopped, a waistband beginning is clamped and extracted from a supply with the end of the waist extension moved from the folding attachment and cuffed in feed direction. Thereafter the remaining waistband length is sewn blind onto the waistband beginning under forward feed and then onto the waist edge of a pair of trousers or of a skirt, an inner covering strip being sewn in also.

The apparatus for carrying out the method comprises a turnover slide and a counter-holder for pincer-like holding of the end of the waist extension during cuffing, the counter-holder being pushed out of the end of the waist extension by the turnover slide. For feeding the waistband with the finished end of the waist extension to the needles, an auxiliary slide which is introduced into the blindstitch folding attachment is provided. A sensor system responding to the end of the waist extension serves to initiate a sequence control of the sewing machine and of the apparatus for carrying out the method.

13 Claims, 3 Drawing Sheets

METHOD AND APPARATUS FOR SEWING A WAISTBAND AND APPLYING IT TO A GARMENT

BACKGROUND OF THE INVENTION

Field of the Invention

The invention relates, in general, to sewing and, in particular, to a method for sewing a waistband onto a garment by means of a two-needle sewing machine and to an apparatus for carrying out the method.

The state of the art concerning this is documented by U.S. Pat. No. 3,183,869. According to this known method, it is possible only to make waistbands with a terminating edge of the waist extension which results from the turning up of the waistband end which extends perpendicular to the longitudinal direction of the waistband.

The attempt to comply with the desire of the sewing industry for the making of waistbands with a waist extension of a different geometric form, e.g. with round, pointed, or polygonal terminating edge, was made by demonstration of a method published in the company journal "Pfaff Information For the Sewing Industry", No. 2, 1979. According to this method, the finished sewn waist extension must be pulled back with the aid of a hooked needle, turning it inside out, finishing it in the region of the upturned edge with the desired shaped seam, trimming it alongside the seam, and subsequently it must be turned into the final form with the top sides out. This procedure is time-consuming and complicated. It was therefore used only to a limited extent for special requests of customers, although no additional investments were necessary besides the blind waistband sewing machines normally existing in the plants.

SUMMARY OF THE INVENTION

A method has been invented by which waistbands with a waist extension of any desired geometric form of the terminating edge can be produced in a smooth and hence time-efficient and rational procedure.

The method according to the invention permits the use of the apparatus known from U.S. Pat. No. 3,183,869 while continuing with the procedure well introduced in the garment industry. It expands the possible applications of the blind waist sewing machine existing in most plants and makes possible a rational production of waistbands with a waist extension of any desired geometric form of the terminating edge.

Controlled handling of the waist extension and its end and achieving high accuracy of form is the purpose of one procedure according to the invention.

Because the finished end of the waist extension is taken out of the blindstitch folding attachment and brought into a position advantageous for the cuffing in the normal work feed direction with the sewing machine stopped, the seams being continued elsewhere, loose thread ends will result. To secure the seams against unintended opening up at the interruption points is the purpose of the measure according to another embodiment, without the threat of adverse consequences for the seams.

Slipping of the material is avoided by one of the measures according to the invention, and it is also possible to largely automate the making and sewing on of a waistband with an end of the waist extension in any desired geometric form.

To keep the space for supplying the work to the stitch formation point freely accessible, the turnover slide and its counter-holder are made movable. High accuracy of form of the end of the waist extension is also achieved by the inventive method.

By the use of an auxiliary slide, the finished end of the waist extension is brought into a position advantageous for the cuffing process simultaneously with the feeding of the waistband beginning.

As a conspicuous and therefore relatively easily recognizable sign, the end of the waist extension is made use of, for initiating a sequence control of the sewing machine and of the respective apparatus for carrying out the method according to the invention.

Accordingly, it is an object of the invention to provide a method for sewing a waistband to a garment using a two-needle sewing machine with a blind-stitch folding attachment which is arranged behind the needles and which includes feeding the waistband to a blind-stitch folding mechanism where the edges are folded over and sewn to a center waistband extension portion to turn over the sides thereof and wherein the turned-over edges are sewn blind onto the already-sewn waistband and after a certain length of the waistband is sewn to the central portion of the waistband extension as the material is moved in a reverse direction, the sewing machine is stopped and the sewing is then moved in an opposite direction as the material is drawn off the folding attachment.

A further object of the invention is to provide an apparatus for effecting the holding of a waistband extension workpiece during sewing which includes a guide tongue which is horizontally and vertically adjustable employed adjacent of blind-stitch folding attachment with the tongue being movable so that it goes into an inner space between two adjustable fold faces which are formed by turning up the fold edges of the waistband around the guide tongue in a manner such that the front edge protrudes to a point where it can be inserted into a sewing machine having two needles and which cooperates with a counter holder which is movable in an opposite direction to the guide tongue and will grip the garments between them so that the end of the waist extension may be cuffed, the counter holder being effected during cuffing to be pushed out of the end of the waistband extension by the movement of a slide carrying the guide tonque.

A further object of the invention is to provide an apparatus for use with a sewing machine having two stitching needles for effecting the feeding of a waistband and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
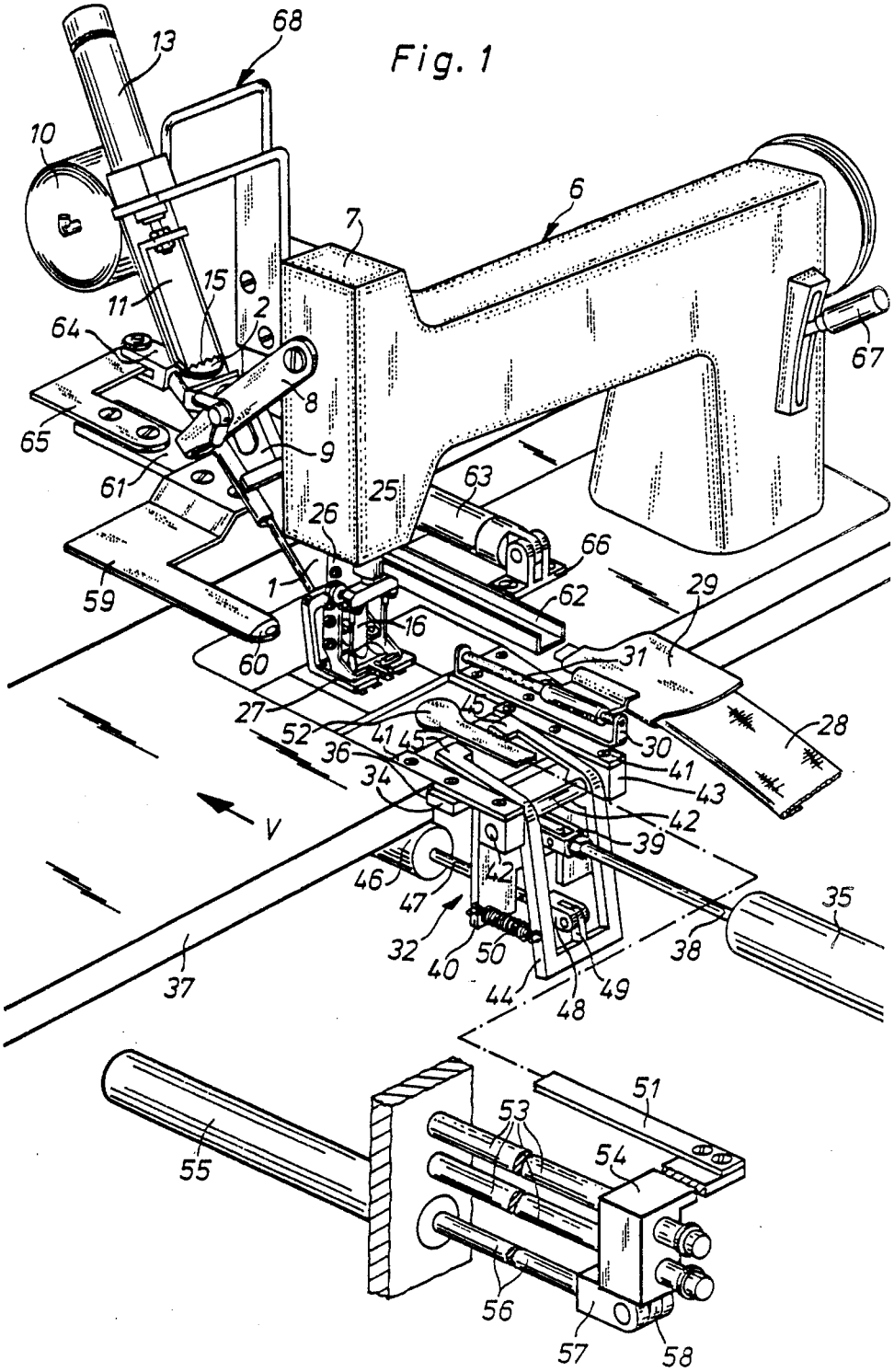
FIG. 1 is a perspective view of the apparatus for carrying out the new method of the invention, on a sewing machine illustrated in simplified form.
Figure 2:
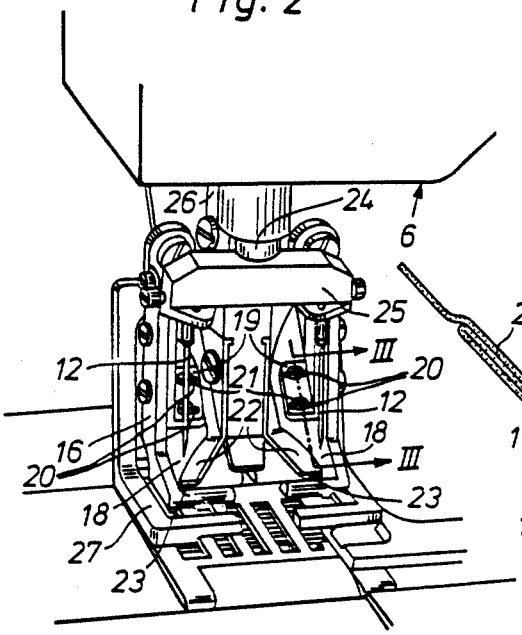
FIG. 2 is a perspective view of the stitch formation point of the sewing machine with the blindstitch folding attachment disposed behind the needles.
Figure 3:
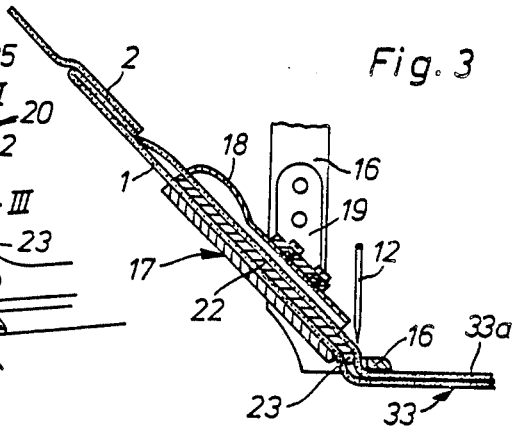
FIG. 3 is a section taken along line III—III of FIG. 2, with the waistband inserted, before the cuffing of the presewn and trimmed end of the waist extension.

Referring to the drawings, in particular, the invention embodied therein comprises a method for sewing a waistband to a garment by means of a two-needle sewing machine using a blind stitch folding attachment 17 which is disposed behind two operable stitching needles 12 and which includes an operating mechanism for holding the workpiece as it is being sewn.

The new method of the invention is carried out using a waistband 1 which, for the formation of an end portion or the later end 2 of the waist extension 3, had been pre-sewn, with the top sides lying one on the other. It is sewn with a semicircular seam 4 locked at the beginning and end by several stitchse at one and the same point. Prior to this they were trimmed e.g. by a knife 5, on a separate two-needle sewing machine having a top, bottom, and needle transport system. The sewing machine 6 is of known design and will therefore be described only to the extent necessary for comprehension of the invention.

Behind the head 7 of the sewing machine 6, there is fastened by means of a support 8 a known edge folding attachment 9, by which the waistband 1, coming from a roll 10 consisting of several waistbands prepared as described above and fastened one to the other, is supplied to the needles 12 by a pneumatically actuated feed slide 11 with the end 2 pointing in the feed direction (arrow z, FIGS. 9, 10), with the inner side up and with the edges 33*a* , 33*b* folded over by 180°.

The feed slide 11 is driven by a single-action pneumatic cylinder 13, on the piston rod 14 to which the feed slide 11 is fastened, and, in the housing of which a return spring is disposed, in known manner. The front edge 15 of the feed slide 11 may be toothed to improve its grip with the waistband 1.

Firmly connected with the top transport foot 16 of the sewing machine 6 is a blindstitch folding attachment 17 which has two folding plates 18 which are adjustably fastened to angle pieces 19 of the top transport foot 16 by means of screws 21 passed through slots 20 in the angle pieces 19. In the inner space between the folding plates 81, two adjustable guide tongues 22 secured on the top transport foot 16 are arranged. The front edge 23 of each tongue 22 protrudes up to the needles 12, which are secured in the needle holder 25 secured on the up and down-moving needle bar 24. In addition to the up and down movements, the needle bar 24 executes together with the top transport foot 16 swinging movements in a forward feed direction, arrow V.

The top transport foot 16 is surrounded by a presser frame 27 secured on the presser bar 26.

For feeding an inner waist covering strip 28 there is used a strip folding attachment 29 disposed before the needles 12 which is mounted for downward pivoting and longitudinal displacement on a spindle 31 secured in a fixed support 30.

Laterally of the covering strip folding attachment 29 a clamping device 32 for the inner part 33 of the waist extension 3 is arranged. The clamping device 32 includes a slide 34 which by a single-action pneumatic cylinder 35 is displaceable in guide grooves 36 in the table board 37 parallel to the work feed direction, arrow V. The forked piece 39, fastened on the end of the piston rod 38 of cylinder 35 displaceable counter to the action of a return spring in the cylinder housing, is connected with a vertical member 40 provided at two bearing pieces 43 which are fastened on the slide 34 through fillets 41 and which receive a spindle 42. An angular clamping frame 44 with two jaws 45 can pivot about the spindle 42. It is to be operated by a single-action pneumatic cylinder 46, the forked piece 48 of which, fastened on the end of the piston rod 47, is connected with a member 49 of the clamping frame 44. The frame 44 is under the action of an extension spring 50 which engages at the vertical member 40 at one end and at the clamping frame 44 at the other end.

In front of the needles 12 there is provided a turnover slide 51 with a free end 52 adapted to the shaped seam 4, for the cuffing of the end 2 of the waist extension 3, which slide is secured on a support 54 movable on two fixed guide rods 53. The support 54 with the turnover slide 51 is movable by a double-action pneumatic cylinder 55, the forked head 57 of which, secured on the piston rod 56, is connected with a vertical member 58 of the support 54. The front end 52 of the turnover slide 51 may be made spreadable.

Cooperating with the turnover slide 51/52 is a counter-holder 59, the free end of which is adapted to the shaped seam 4 and can be introduced into the small pocket formed by the seam, which pocket forms the end 2 of the waist extension 3 after the cuffing.

The counter-holder 58 is secured on a sliding piece 61 which is displaceable parallel to the work feed direction, arrow V, and which runs on a track 62 fastened on the sewing table 37. As drive means a pneumatic cylinder 63 is provided, the piston rod of which is connected with the sliding piece 61 by a forked head 64 and an angle plate 65.

The pneumatic cylinder 63 is connected at one end with a forked piece 66 secured on the table 37. For changing the work feed direction of the sewing machine 6, the stitch length setting lever 67 is provided on the front of the sewing machine. Driven by a positioning motor in known manner and therefore not illustrated in detail, the sewing machine 6 is equipped with a thread cutter and a presser foot lifting device.

According to the new method, the waistband 1, cut approximately to the needed length, is first turned up on a length substantially corresponding to the waist extension 3 in such a way that the top sides lie one on the other. Then the shaped seam 4, in the embodiment a semicircular one, locked at the beginning and end by a few stitches without feed or with reverse feed, is formed and at the same time the strip edge is trimmed by a knife 5. Several waistbands thus prepared are then attached one to the other unfolded and are rolled up to a roll 10, FIG. 1, which is placed on a holding device 68 in such a way that the presewn and trimmed shaped ends 2 lie on top when being supplied to the stitch formation point.

With the sewing machine 6 stopped in a needle up position, with the presser frame 27 raised, with the clamping device 32 open, with the turnover slide 51 and counter-holder 59 retracted in inactive position, and with the cover strip folding attachment 29 with inserted cover strip 28 swung away about the spindle 31, the waistband beginning 33 is supplied to under the point of insertion of the needles 12 while being supported by the feed slide 11 engaging at the end 2, through and across the edge folding attachment 9, its front edge pointing in feed direction (arrow z, FIGS. 9, 10), the edges 33*a* and 33*b* being turned up and over the folding plates 18 around the guiding tongues 22 by 180°.

The presser frame 27 having been lowered, the sewing machine 6 is turned on, and the edges 33*a* and 33*b* are sewn onto the center part of the waist extension 3 by the seams 69 and 70 in reverse feed direction 2, that is, counter to the direction marked by arrow V. At the points intended for that purpose, the seams 69 and 70 are locked by a few stitches with reduced feed or without feed of the waistband 1, as indicated at 71 and 72. The sewing machine 6 is stopped in needle up position and the presser frame 27 is raised.

Figure 4:
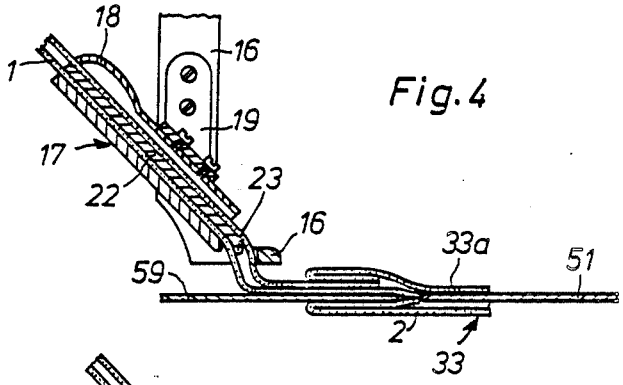
FIG. 4 is an illustration similar to FIG. 3, in which the waistband with the end is pulled through the blindstitch folding attachment into the position for cuffing.
Figure 6:
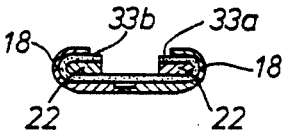
FIG. 6 is a section taken along line VI—VI of FIG. 5.
Figure 7:
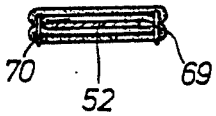
FIG. 7 is a section taken along line VII—VII of FIG. 5.

By the piston rod 38 connected with the working piston of the pneumatic cylinder 35 the opened clamping device 32 is then moved toward the needles 12. By the piston rod 47 connected with the working piston of the pneumatic cylinder 46 the clamping frame 44 is then pivoted counter to the action of the extension spring 50 about the spindle 42 counterclockwise relative to FIG. 1. In so doing, the waistband beginning 33 with the turned-up edges 33*a* and 33*b* is clamped. Thereafter the compressed air supply to the pneumatic cylinder 35 is reversed in such a way that the clamping device 32 is retracted into its starting position, thus taking along the waistband beginning 33 until the presewn and trimmed end 2 of the waist extension 3 is pulled out of the blindstitch folding attachment 17 approximately into the position shown in FIG. 4.

Thereupon, the counter-holder 59 is inserted by the pneumatic cylinder 63 into the small pocket of the end 2 of the waist extension 3 outlined by the shaped seam 4, and the turnover slide 51 is moved (4) by the piston rod 56 of cylinder 55 for the cuffing through of the end 2, passing under the presser frame 27, the top transport foot 16 and the front edge 23 of the guiding tongues 22, against the trimmed edges of the end of the waistband 1 and against the end 60 of the counter-holder 59, so that during the cuffing process the region of these edges is gripped in pincer fashion from both sides in the seam joint between the end 52 of the turnover slide 51 and the end 60 of the counter-holder 59.

Figure 5:
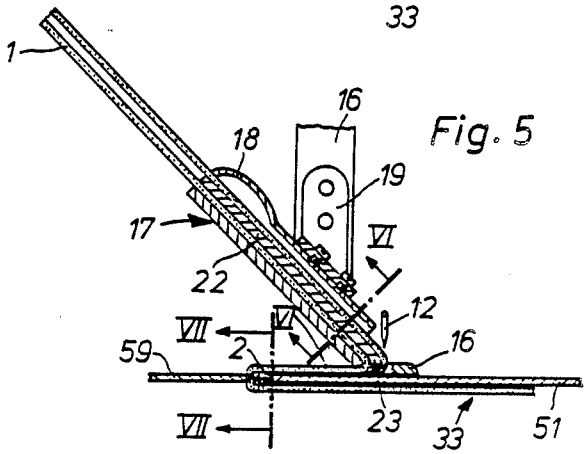
FIG. 5 is an illustration similar to FIG. 4 after the cuffing of the end of the waist extension.

During the cuffing of the end 2, the counter-holder 59 is pushed back in the direction of its starting position by the turnover slide 51 counter to the action of the weaker pneumatic cylinder 63. A controlled, form-correct cuffing of end 2 is thereby ensured. At the end of the cuffing process the component parts of the waist extension 3 occupy the position illustrated in FIGS. 5 and 10.

Then the presser frame 27 is lowered, the stitch length setting lever 67 switched to feed in the direction of arrow V, the clamping device 32 is opened by venting of the pneumatic cylinder 46, in that the extension spring 50 pivots the clamping frame 44 with the clamping jaws 45 back into the starting position clockwise (referred to FIG. 1) about the spindle 42 and then moves it back into the starting position through the pneumatic cylinder 35. Similarly, also the turnover slide 51 and its counter-holder 59 are pulled back into their starting position by the pneumatic cylinders 55 and 63, respectively.

Then the sewing machine 6 is turned on again. One sews first a few stitches with reduced stitch length or without feed for seam locking, and subsequently the waistband 1 is taken off the roll 10 by the edge-folding attachment 9 and the blindstitch folding attachment 17 on the attachment is sewn onto the waistband beginning 33 in blind stitch fashion with work feed in the direction of arrow V, FIG. 1, to form the waist extension 3, piercing only the fold edges 33c and 33d of the entrained waistband 1 supplied around the front edge 23 of the folding tongues 22 up to the movement plane of the needles 12, the fold edges 33*a* and 33*b* , and the central part of the waistband beginning 33, FIGS. 5 and 10.

Figures 8, 9, 10, 11, 12:
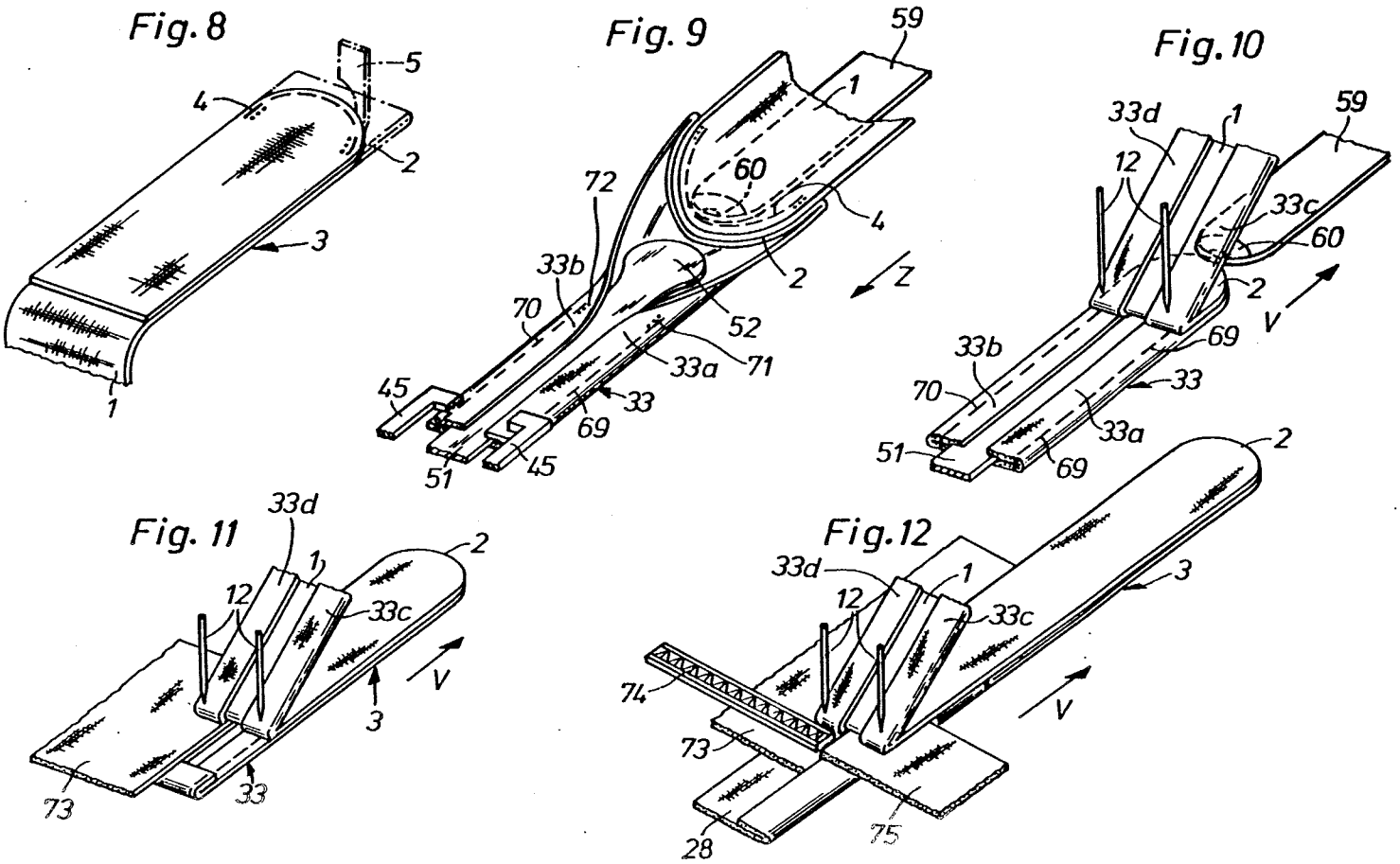
FIG. 8 is a perspective view of the parts, their top sides lying one on the other, of the waistband forming the waist extension, which parts are presewn with a semicircular seam to form an end and are trimmed.
FIG. 9 is a view similar to FIG. 8, in perspective, the waistband beginning, sewn with backward feeding, and the end of the waist extension in the position as it is being guided through the blindstitch folding attachment, before the cuffing, with a portion of the turnover slide and of the waistband clamp.
FIG. 10 is a perspective view of the parts of the waist extension worked according to FIG. 9, after the cuffing of the end in forward direction of the work, with the turnover slide.
FIG. 11 is a view similar to FIG. 10, in which the rim edge of a trouser part is inserted between the parts of the waist extension.
FIG. 12 is an illustration similar to FIG. 11 showing the inner covering, the waist lining, and an applied belt loop.

As shown in FIGS. 11 and 12, after a certain length of seam the waist rim of a trouser cut 73 is applied and, to begin with, sewn in between the waistband beginning 33 and the entrained waistband 1. Then the inner cover strip 28, abutting against the preferably turned-up transverse edge of the waistband beginning 33, is taken along under the trouser cut 73, continuing with the sewing of the trouser waist and applying the desired member of belt loops 74.

At the point intended for that purpose, the belting 75 is supplied, and at the end of the trouser cut 73 the sewing machine is stopped, the threads are cut off, the work is removed after the presser frame 27 has been raised, and the waistband 1 and the inner cover strip 28 are cut off.

Lastly, on a single-needle sewing machine the terminating list edge of the trouser 73 is sewn together with the belting 75 on the reverse side, and the belting 75 is turned upside down and secured parallel to the list edge.

In summary the method of the invention is carried out as follows:

A method for sewing a waistband into a garment by means of a two-needle sewing machine, using a blind stitch folding attachment which is disposed behind the needles and feeds the material to be sewn, comprising folding a waistband strip adjacent with one end back upon itself at a predetermined location adjacent this one end, sewing a form seam along an edge of the profile end to form a pocket shape profile end and cutting it adjacent profile end to said form seam, winding the waistband strip with the form seam into a continuous roll, pulling the end of the roll toward the sewing needle through a folder which effects the folding of each side edge of the form seam upon the center of the form seam while the sewing machine is not working, sewing seams and barring stitches along each edge of the folded over side edges of the strips as the material is advanced in a first feeding direction by the sewing machine, stopping the sewing machine, clamping the leading end of the strip, pulling the profile end out of the folder, moving a counter holder from one side of the strip into the pocket shape profile and a tongue against the opposite side of the strip against the counter holder, moving both the counter holder and the tongue, together in a direction opposite to the first feed direction to form a folded over portion and a remaining portion of the strip to turn the pocket shape profile inside out, placing an inner band and a belt loop between the upper and lower portions of the strip and starting the sewing machine and sewing a part of the folded over portion of the strip to the remaining portion as the sewing machine advances the strip in the direction opposite to the first feed direction.

While specific embodiments of the invention have been shown and described in detail to illustrate the application of the principles of the invention, it will be understood that the invention may be embodied otherwise without departing from such principles.

What is claimed is:

1. Method for sewing a waistband to a garment by means of a two-needle sewing machine using a blindstitch folding attachment which is disposed behind the needles and feeds a waistband and by which the fold edges of the waistband are fed turned up, where after introduction of the beginning of the waistband under the stitch formation point the turned-up fold edges are first sewn for a certain length onto the central part of the waistband with backward feed of the sewing machine and then after the manual turning up of the waistband beginning and reversal of the feed direction of the sewing machine the turned-up fold edges of the entrained waistband are sewn blind onto the already sewn waistband and, after a certain seam length has been made, also onto a covering known per se which, abutting against the beginning of the waistband, and taken along from below, and after the desired length of the waist extension has been reached, the rim edge of the garment is sewn in also between the waistband and the covering, characterized in that a trimmed waistband, turned up on a length substantially corresponding to the waist extension, its top sides lying one on the other, sewn together in the region of the turned-up edge by a shaped seam for the formation of the end of the waist extension, is spread out and the waistband beginning is fed to the stitch formation point with the inner sides up and with the end with the finished and trimmed shaped edge pointing in feed direction folded over by the blindstitch folding attachment with the lateral edges up, then the turned-up fold edges are sewn onto the center part of the waistband for a certain seam length with backward feed of the sewing machine, thereafter the presewn and trimmed end is pulled out of the blindstitch folding attachment through the orifice with the sewing machine stopped and is cuffed in forward feed direction (arrow V) and thereupon the process steps starting with the manual turning up of the waistband beginning are carried out.

2. Method according to claim 1, wherein for the cuffing of the end of the waist extension is clamped in pincer fashion in the seam joint of the shaped seam from the inside and from the outside.

3. Method according to claim 1, wherein the seams are locked before the end of the waist extension is extracted from the blindstitch folding attachment and after the cuffing.

4. Method according to claim 3, wherein the threads are cut off between the locking points.

5. Method according to claim 1, wherein the waistband beginning is clamped for extracting the end of the waist extension from the blindstitch folding attachment and for the duration of the cuffing process of the end.

6. An apparatus for sewing a waistband onto a garment for use with a sewing machine having two reciprocating needles arranged in spaced lateral at a stitching point arrangement and a blindstitch folding attachment which is arranged behind the needles and feeds the materials to be sewn downwardly toward the needles, comprising a tongue arranged in the space between two adjustable fold faces of the workpieces for turning up the fold edges of the waistband around the guide tongue in such a way that the front of the waistband protrudes to the sticking point of the needles, said mechanism including a turnover slide engaging in front of the needles and the end of the waist extension which is finished by the seam for cuffing the end of said waist extension the movement path of said workpiece extending parallel to the fabric delivery plate of the sewing machine onto the top transport and presser foot including a counter holder for the turnover slide arranged behind said needles and introducible into the finished end of said waist extension which counter holder can be pushed out of the end by a turnover slide.

7. An apparatus according to claim 6, wherein said turnover slide is exchangeably fastened on a driven support.

8. An apparatus according to claim 7, wherein said turnover slide and its counter holder can be moved into an operating position to an inactive position situated outside the work supply zone.

9. An apparatus according to claim 7, wherein at least the region of the free end of said turnover slide is spreadable.

10. An apparatus according to claim 6, wherein for a feeding of a waistband with the finished end of a waist extension to a stitch formation point there is an auxiliary slide introducible into the blindstitch folding attachment.

11. An apparatus according to claim 7, wherein a sensor system responding to the end of the waist extension is arranged in the movement path of said waistband for initiating a sequence control of the sewing machine.

12. A method according to claim 1, including trimming around the same curvature as said shaped seam for the formation of the end of the waist extension.

13. A method for sewing a waistband onto a garment by means of a two-needle sewing machine, using a blind stitch folding attachment which is disposed behind the needles and feeds the material to be sewn, comprising folding a waistband strip adjacent with one end back upon itself at a predetermined location adjacent this one end, sewing a form seam along an edge of the profile end to form a pocket shape profile end and cutting it adjacent profile end to said form seam, winding the waistband strip with the form seam into a continuous roll, pulling the end of the roll toward the sewing needle through the folder which effects the folding of each side edge of the form seam upon the center of the form seam while the sewing machine is not working, sewing seams and barring stitches along each edge of the folded over side edges of the strips as the material is advanced in a first feeding direction by the sewing machine, stopping the sewing machine, clamping the leading end of the strip, pulling the profile end out of the folder, moving a counter holder from one side of the strip into the pocket shape profile and a tongue against the opposite side of the strip against the counter holder, moving both the counter holder and the tonque together in a direction opposite to the first feed direction to form a folded over portion and a remaining portion of the strip to turn the pocket shape profile inside out, placing an inner band and a belt loop between the upper and lower portions of the strip and starting the sewing machine and sewing a part of the folded over portion of the strip to the remaining portion as the sewing machine advances the strip in the direction opposite to said first feed direction.

* * * * *